US012577874B2

(12) United States Patent
Dufour et al.

(10) Patent No.: US 12,577,874 B2
(45) Date of Patent: Mar. 17, 2026

(54) WIRELESS DOWNHOLE ACOUSTIC TELEMETRY SYSTEMS AND PROCESSES FOR INSTALLING AND USING SAME

(71) Applicant: Schlumberger Technology Corporation, Sugar Land, TX (US)

(72) Inventors: Yann Dufour, Houston, TX (US); Fernando Garcia-Osuna, Sugar Land, TX (US); Arnaud Croux, Paris (FR); Arnaud Jarrot, Peynier (FR); Kaiyang Liew, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 20 days.

(21) Appl. No.: 18/679,510

(22) Filed: May 31, 2024

(65) Prior Publication Data

US 2025/0369351 A1 Dec. 4, 2025

(51) Int. Cl.
*E21B 47/16* (2006.01)

(52) U.S. Cl.
CPC ..... *E21B 47/16* (2013.01)

(58) Field of Classification Search
None
See application file for complete search history.

(56) References Cited

U.S. PATENT DOCUMENTS

| | | | | |
|---|---|---|---|---|
| 4,784,154 | A * | 11/1988 | Shirley | A61B 7/04 600/528 |
| 8,605,548 | B2 | 12/2013 | Froelich | |
| 9,645,266 | B2 * | 5/2017 | Gao | G01V 1/22 |
| 11,713,653 | B2 * | 8/2023 | Feluch | E21B 43/126 166/254.2 |
| 2020/0219526 | A1 * | 7/2020 | Qi | G10L 25/51 |

FOREIGN PATENT DOCUMENTS

AU 2016204117 B2 12/2017

* cited by examiner

*Primary Examiner* — Steven Lim
*Assistant Examiner* — Jerold B Murphy
(74) *Attorney, Agent, or Firm* — Jeffrey D. Frantz

(57) ABSTRACT

Telemetry systems that include a wireless acoustic telemetry system and processes for installing and using same. In some embodiments, a wireless acoustic telemetry system can include a plurality of transducer assemblies spatially distributed on or about a pipe string. Each transducer assembly can include a modem and a plurality of transducers each coupled to a corresponding different body such that each transducer assembly comprises a plurality of independently mass-loaded transducers. At least two mass-loaded transducers in each mass-loaded assembly can be tuned to a specific resonance frequency, and each specific resonance frequency can be spaced in frequency such that the at least two mass-loaded transducers in each mass-loaded assembly together can be configured to provide a wider frequency response band for energy transmission as compared to one of the at least two mass-loaded transducers alone.

8 Claims, 4 Drawing Sheets

WIRELESS DOWNHOLE ACOUSTIC TELEMETRY SYSTEMS AND PROCESSES FOR INSTALLING AND USING SAME

FIELD

Embodiments described generally relate to wireless acoustic telemetry systems. More particularly, such embodiments relate to wireless acoustic telemetry systems that can include wideband and/or low frequency acoustic signals and processes for installing and using same.

BACKGROUND

Typical downhole acoustic telemetry systems use a network of single transducer acoustic modems. A telemetry transmitter module emits acoustic waves that carry the input telemetry signals using standard modulation techniques. A telemetry receiver module includes one sensor receiver channel that feeds a demodulation processing method. The demodulation signal is the output of the receiver module. For successful communication of the telemetry signal from the transmitter to the receiver, the demodulated signal should be equivalent to the input telemetry signal. The telemetry receiver typically does not receive a perfect version of the transmitted signal. First, the acoustic signal is attenuated while the signal propagates from the transmitter to the receiver. Second, the receiver also receives noise components generated by several sources.

A network of modems is usually needed to relay the telemetry signals from the initial transmitter to the final receiver. A typical example is to transmit information generated by a downhole sensor to an operator on the rig. The acoustic channel across a string of pipes displays a structure with passbands and stopbands. An acoustic signal can propagate across multiple pipes in the passbands, but the signal does not propagate well in the stopbands. When the pipes have differing lengths, the signal attenuates, with stronger attenuation at higher frequency. To generate acoustic energy in the pipes, a mass loaded piezo-transducer, such as the one commercialized by Cedrat (PPA40L for example) has been used. Such transducers have proven to be effective, but the communication distance is limited to a few thousand feet because the acoustic energy is too low at the receiver side. Building a network of relaying modems is feasible but comes at high cost and the overall reliability of the system can be impeded.

Multiple limitations explain a low amplitude at the receiver side of existing systems. A typical mass loaded transducer has a resonance frequency greater than 2 kHz, where the attenuation in the passbands is higher than 10 dB per about 305 meters. Also, the bandwidth of the resonance of current transducers is narrow compared to the size of the passbands and stopbands. It is impractical to tune the resonance frequency to the passbands. Hence, current transducers are mostly used outside of their resonance frequency to ensure transmission in a passband. All acoustic modes are excited by one mass loaded transducer, whereas only one predominant mode provides good propagation characteristics.

There is a need, therefore, for improved wireless acoustic telemetry systems.

SUMMARY

Telemetry systems that include a wireless acoustic telemetry system and processes for assembling and using the same are provided. In some embodiments, a wireless acoustic telemetry system can include a plurality of transducer assemblies spatially distributed on or about a pipe string. Each transducer assembly can include a modem and a plurality of transducers each coupled to a corresponding different body such that each transducer assembly comprises a plurality of independently mass-loaded transducers. At least two mass-loaded transducers in each mass-loaded assembly can be tuned to a specific resonance frequency, and each specific resonance frequency can be spaced in frequency such that the at least two mass-loaded transducers in each mass-loaded assembly together can be configured to provide a wider frequency response band for energy transmission as compared to one of the at least two mass-loaded transducers alone.

In some embodiments, a process for installing a wireless acoustic telemetry system can include installing the wireless acoustic telemetry system onto a pipe string that is to be located within a borehole. The wireless acoustic telemetry system can include a plurality of transducer assemblies spatially distributed on or about the pipe string. Each transducer assembly can include a modem, a plurality of transducers, and a plurality of bodies. Each transducer in the plurality of transducers can be coupled to a corresponding different body in the plurality of bodies such that each transducer assembly can include a plurality of independently mass-loaded transducers. At least two of the mass-loaded transducers in each transducer assembly can be tuned to a specific resonance frequency, and each specific resonance frequency can be spaced in frequency such that the at least two mass-loaded transducers in each mass-loaded assembly together can be configured to provide a wider frequency response band for energy transmission as compared to one of the at least two mass-loaded transducers alone.

In some embodiments, a wireless acoustic telemetry system can include a plurality of transducer assemblies spatially distributed on or about a pipe string. Each transducer assembly can include a modem, a plurality of transducers, and a single body. Each transducer in the plurality of transducers can be coupled to the single body such that each transducer assembly comprises a plurality of mass-loaded transducers coupled to the single body. At least two mass-loaded transducers in each transducer assembly can be tuned to a specific resonance frequency, and each specific resonance frequency can be spaced in frequency such that the at least two mass-loaded transducers in each transducer assembly together can be configured to provide a wider frequency response band for energy transmission as compared to one of the at least two mass-loaded transducers alone.

In some embodiments, a process for installing a wireless acoustic telemetry system can include installing the wireless acoustic telemetry system onto a pipe string that is to be located within the borehole. The wireless acoustic telemetry system can include a plurality of transducer assemblies spatially distributed on or about a pipe string. Each transducer assembly can include a modem, a plurality of transducers coupled to a single body such that each transducer assembly comprises a plurality of mass-loaded transducers. At least two mass-loaded transducers in each mass-loaded assembly can be tuned to a specific resonance frequency, and each specific resonance frequency can be spaced in frequency such that the at least two mass-loaded transducers in each mass-loaded assembly together can be configured to provide a wider frequency response band for energy transmission as compared to one of the at least two mass-loaded transducers alone.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are, therefore, not to be considered limiting of its scope, for the invention may admit to other equally effective embodiments. It is emphasized that the figures are not necessarily to scale and certain features and certain views of the figures can be shown exaggerated in scale or in schematic for clarity and/or conciseness.

DETAILED DESCRIPTION

Figure 1:
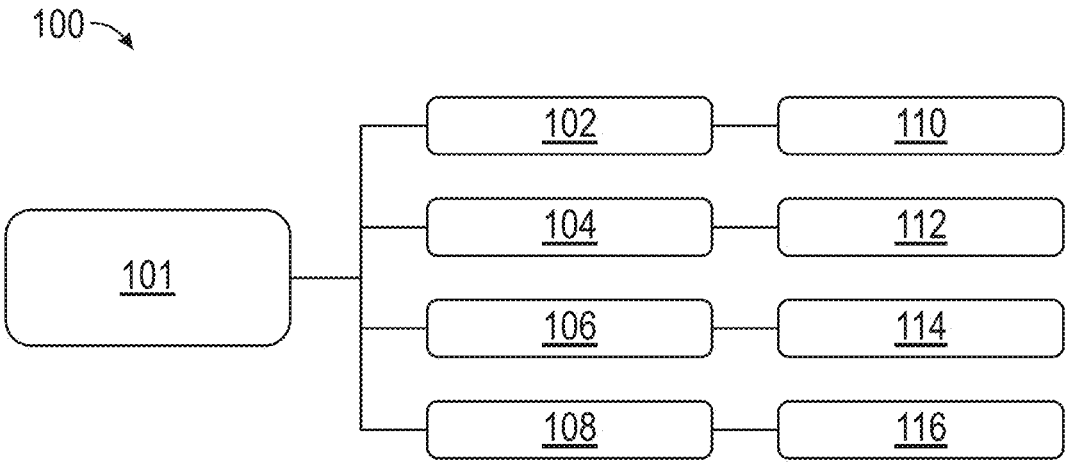
FIG. 1 depicts an illustrative transducer assembly that includes four transducers, each transducer loaded with a separate body, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure can repeat reference numerals and/or letters in the various embodiments and across the figures provided herein. This repetition is for the purpose of simplicity and clarity and does not in itself dictate a relationship between the various embodiments and/or configurations. Moreover, the exemplary embodiments presented below can be combined in any combination of ways, i.e., any element from one exemplary embodiment can be used in any other exemplary embodiment, without departing from the scope of the disclosure.

Additionally, certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Furthermore, in the following discussion and in the claims, the terms "including" and "comprising" are used in an open-ended fashion, and thus should be interpreted to mean "including, but not limited to."

The term "or" is intended to encompass both exclusive and inclusive cases, i.e., "A or B" is intended to be synonymous with "at least one of A and B," unless otherwise expressly specified herein.

The indefinite articles "a" and "an" refer to both singular forms (i.e., "one") and plural referents (i.e., one or more) unless the context clearly dictates otherwise. For example, embodiments using "an olefin" include embodiments where one, two, or more olefins are used, unless specified to the contrary or the context clearly indicates that only one olefin is used.

Unless otherwise indicated herein, all numerical values are "about" or "approximately" the indicated value, meaning the values take into account experimental error, machine tolerances and other variations that would be expected by a person having ordinary skill in the art. It should also be understood that the precise numerical values used in the specification and claims constitute specific embodiments. Efforts have been made to ensure the accuracy of the data in the examples. However, it should be understood that any measured data inherently contains a certain level of error due to the limitation of the technique and/or equipment used for making the measurement.

Each of the appended claims defines a separate invention, which for infringement purposes is recognized as including equivalents to the various elements or limitations specified in the claims. Depending on the context, all references to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions, and examples, but the inventions are not limited to these embodiments, versions or examples, which are included to enable a person having ordinary skill in the art to make and use the inventions, when the information in this disclosure is combined with publicly available information and technology.

FIG. 1 depicts an illustrative transducer assembly 100 that includes a plurality of transducers (four are shown, 102, 104, 106, and 108) each loaded with a separate body (four are shown 110, 112, 114, and 116), according to one or more embodiments. The transducer assembly 100 can include a modem 101, the plurality of transducers 102, 104, 106, and 108, and the plurality of bodies or weights 110, 112, 114, and 116. The transducer assembly 100 can include any number of transducers each loaded with a separate body to create mass-loaded transducers. In some embodiments, the transducer assembly can include two, three, four, five, six, seven, eight, nine, ten, or more transducers each loaded with a separate body. The transducers 102, 104, 106, 108 can convert an electrical signal to an acoustic signal that can then be communicated using pipe string as the transmission medium. The modem 101 can also include a receiving system that can utilize the transducers 102, 104, 106, 108 to convert an acoustic signal to an electrical signal. Additionally, the modem 101 can have the ability to convert signals from analog form to digital form and can include a processing system to process digital data, including, for example, a microcontroller and/or a programmable gate array. Generally, the modem 101 can receive a message and can process it. If the message is locally addressed to the modem 101, the modem 101 can manage the information (e.g., a command) carried in the message. If the modem 101 is the ultimate destination, it can execute the command. Otherwise, the modem 101 can retransmit the message along the transmission medium to a next modem 101. This process can be repeated so that the message continues to propagate to its ultimate destination.

The transducers 102, 104, 106, 108 can include, for example, piezo-electric, magneto restrictive, and/or electromagnetic, or any other element or combination of elements that are suitable for converting an acoustic signal to an electrical signal and/or converting an electrical signal to an acoustic signal. The plurality of transducers 102, 104, 106, and 108 can be coupled with the corresponding body or weight 110, 112, 114, and 116. In some embodiments, at least two of the plurality of transducers 102, 104, 106, and 108 can be tuned with a specific resonance frequency that can be different from one another. In some embodiments, the plurality of transducers 102, 104, 106, 108 can each have a specific resonance frequency that can be different from one another. The specific resonance frequency for each transducer 102, 104, 106, 108 can be tuned via the particular weight of each body 110, 112, 114, 116, respectively, and/or by adjusting a stiffness of each of the transducers 102, 104, 106, 108. The plurality of bodies or weights 110, 112, 114, and 116 can include any suitable material for achieving a fixed and/or desired mass as required to tune the plurality of transducers 102 to achieve the desired specific resonance frequencies. In some embodiments, at least two mass-loaded transducers in each mass-loaded assembly can be tuned to a specific resonance frequency. In a preferred embodiment, at least two mass-loaded transducers in each mass-loaded assembly can be tuned to a unique or different resonance frequency and each unique or different resonance frequency can be spaced in frequency such that the at least two mass-loaded transducers in each mass-loaded assembly together can be configured to provide a wider frequency response band for energy transmission as compared to one of the at least two mass-loaded transducers alone.

In some embodiments, each body or weight 110, 112, 114, and 116 can independently have a weight of about 0.1 kg, about 0.25 kg, about 0.5 kg, about 1 kg, about 1.5 kg, about 2 kg, about 2.5 kg, about 3 kg, or about 3.5 kg to about 4 kg, about 4.5 kg, about 5 kg, about 5.5 kg, about 6 kg, about 6.5 kg, about 7 kg, about 7.5 kg, about 8 kg, or more.

Figure 2:
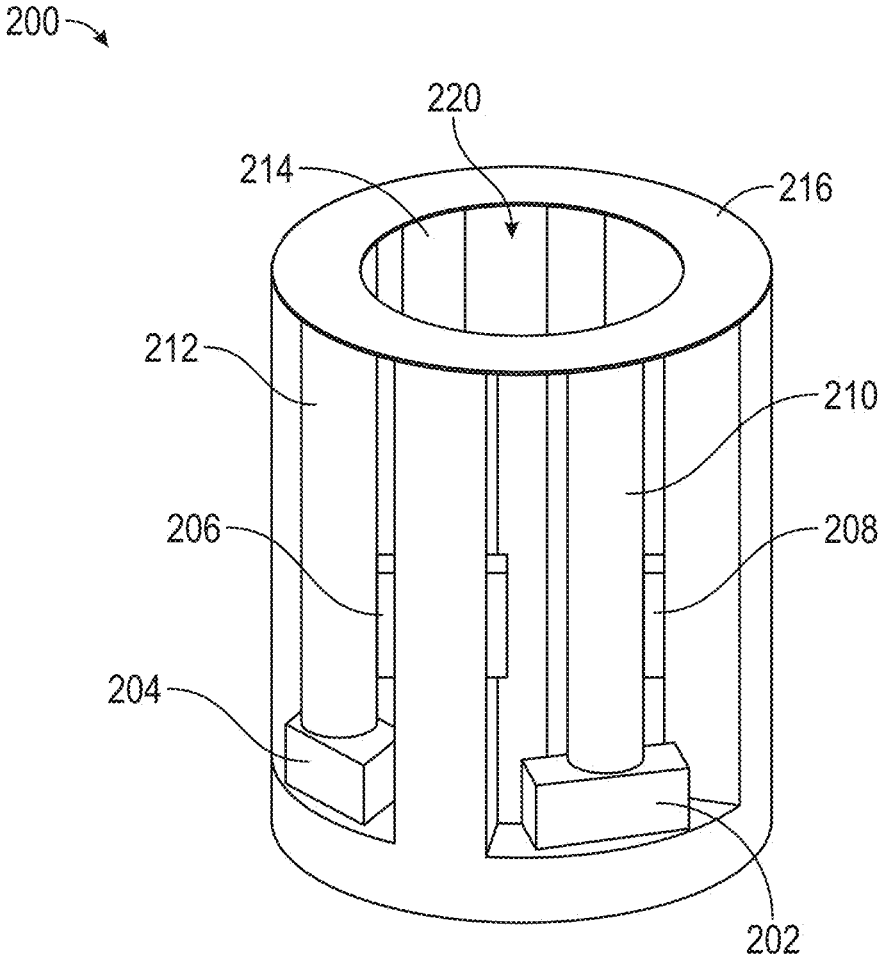
FIG. 2 depicts an illustrative annular ring design of a transducer assembly that includes four transducers, each transducer loaded with a separate body, according to one or more embodiments described.

FIG. 2 depicts an illustrative annular ring design of a transducer assembly 200 that includes four transducers 202, 204, 206, 208 each loaded with a separate body 210, 212, 214, 216, according to one or more embodiments. As depicted, the plurality of transducers 202, 204, 206, 208 can be loaded with an individual body 210, 212, 214, 216 and can be housed within a single assembly to form a transducer assembly 200. The annular ring design of the transducer assembly 200 can define an annular bore 220 through a central longitudinal axis thereof. As such, the transducer assembly 200 can be disposed outside and/or about a pipe string or other elongated body and secured thereto. In one or more embodiments, the transducer assembly 200 can be disposed outside and/or about a pipe string such that the transducer assembly 200 may not affect the acoustic propagation through the pipe string.

Figure 3:
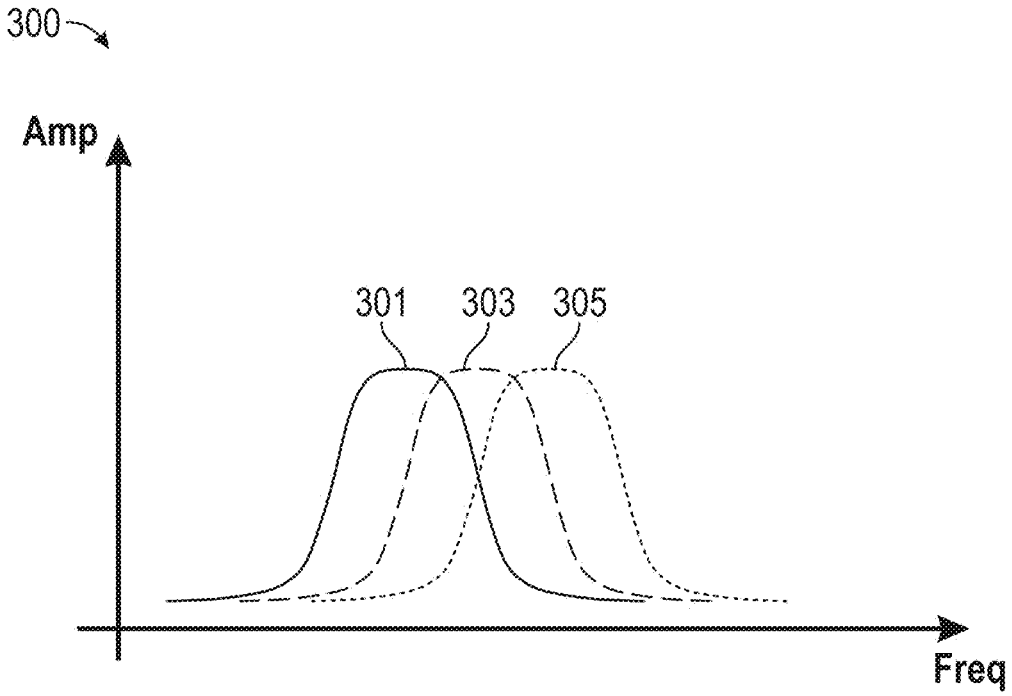
FIG. 3 depicts a graphical representation of a frequency response for three individual piezo-transducers with shifted resonance frequencies, according to one or more embodiments described.

FIG. 3 depicts a graphical representation of the frequency response 300 for three individual piezo-transducers 301 with shifted resonance frequencies, according to one or more embodiments. In some embodiments, three piezo-transducers can each be weighted by a separate body, as described above with reference to FIGS. 1 and 2 to produce a different specific resonance frequency in each of the three mass-loaded piezo-transducers. More particularly, a first of the three piezo-transducers can have a resonance frequency indicated via arrow 301, a second of the three piezo-transducers can have a resonance frequency indicated via arrow 303, and a third of the three piezo-transducers can have a resonance frequency indicated via arrow 305. The resulting shifted resonance frequencies can cover a broader frequency band than any individual mass-loaded piezo-transducer 301 can produce alone. It should be understood, in one or more embodiments, the plurality of transducers 102, 104, 106, 108 that can be coupled to the corresponding body or weight 110, 112, 114, 116, as described above with reference to FIG. 1, can be configured such that each of the plurality of transducers 102, 104, 106, 108 can produce a different specific resonance frequency so that the combination of the plurality of transducers can cover a broader frequency band than any individual mass-loaded transducer can alone.

Figure 4:
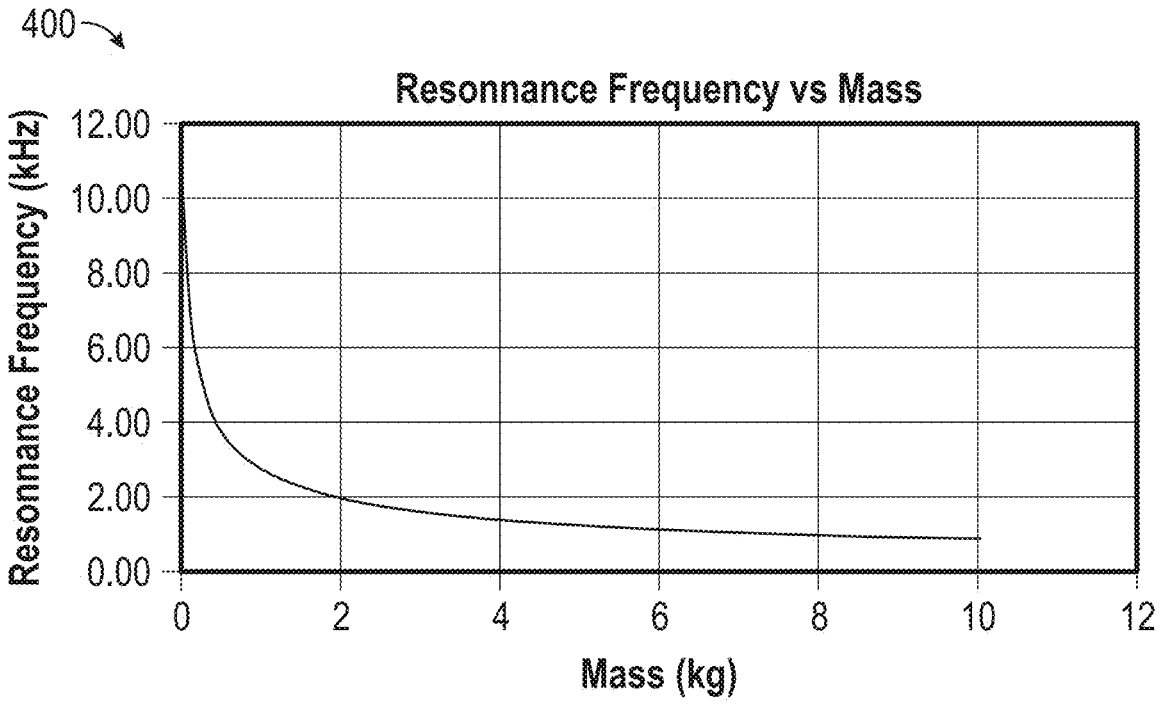
FIG. 4 depicts a graphical representation of the relationship between a resonance frequency and a mass of a typical mass-loaded piezo-transducer, according to one or more embodiments described.

FIG. 4 depicts a graphical representation of the relationship 400 between the resonance frequency and the mass of the loaded body in a piezo-transducer, according to one or more embodiments. Acoustic signals can undergo attenuation or loss as the acoustic signal propagates through a given media or structure or the like. Attenuation of the acoustic signal propagating through pipe string can be higher at higher frequencies. For example, at 3 kHz, the attenuation can be around 20 dB per thousand feet, whereas it can be less than 5 dB per thousand feet at frequencies lower than 1 kHz. In one or more embodiments, frequencies lower than 1 kHz can be preferred. Tuning the resonance frequency of a transducer to such low frequencies can require careful body selection. The resonance frequency versus mass weight relationship for a typical piezo-transducer (PPA40 by Cedrat) can show that a mass of around 6 kg can set the resonance frequency at 1 kHz. In a preferred embodiment, small piezo-transducers can be used because of low impact mechanical integration. The specific resonance frequencies can be further selected to optimize mode excitation in the pipe string. In some embodiments, specific mode excitation can be selected for when tuning a specific resonance frequency to avoid inefficient modes for acoustic propagation in the pipe string. In some embodiments, inefficient modes can be entirely eliminated through the proper placement and tuning of a plurality of transducer assemblies.

Figure 5:
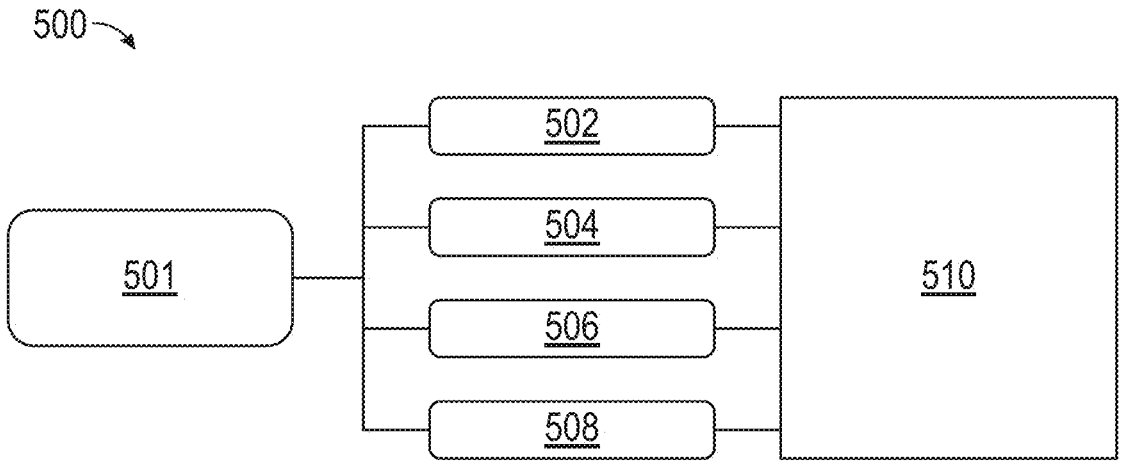
FIG. 5 depicts another illustrative transducer assembly that includes a plurality of transducers each loaded with a single body, according to one or more embodiments described.

FIG. 5 depicts another illustrative transducer assembly 500 that includes a plurality of transducers (four are shown, 502, 504, 506, 508) loaded with a single body, according to one or more embodiments. The transducer assembly 500 can include a modem 501, the plurality of transducers 502, 504, 506, 508, and a single body or weight 510. In some embodiments, the plurality of transducers 502, 504, 506, 508 can each be loaded by the single body or weight 510 to achieve a specific resonance frequency. In some embodiments, and referring to FIGS. 1 and 5, the specific resonance frequency achieved by loading the plurality of transducers 502, 504, 506, 508 with a single body or weight 510 can be lower than the specific resonance frequencies achieved by loading the plurality of transducers 102, 104, 106, 108 with a plurality of bodies or weights 110, 112, 114, 116. In some embodiments, the single body or weight 510 can have a weight of about 0.5 kg, about 1 kg, about 1.5 kg, about 2 kg, about 2.5 kg, about 3 kg, or about 3.5 kg to about 4 kg, about 4.5 kg, about 5 kg, about 5.5 kg, about 6 kg, about 6.5 kg, about 7 kg, about 7.5 kg, about 8 kg, or more.

Figure 6:
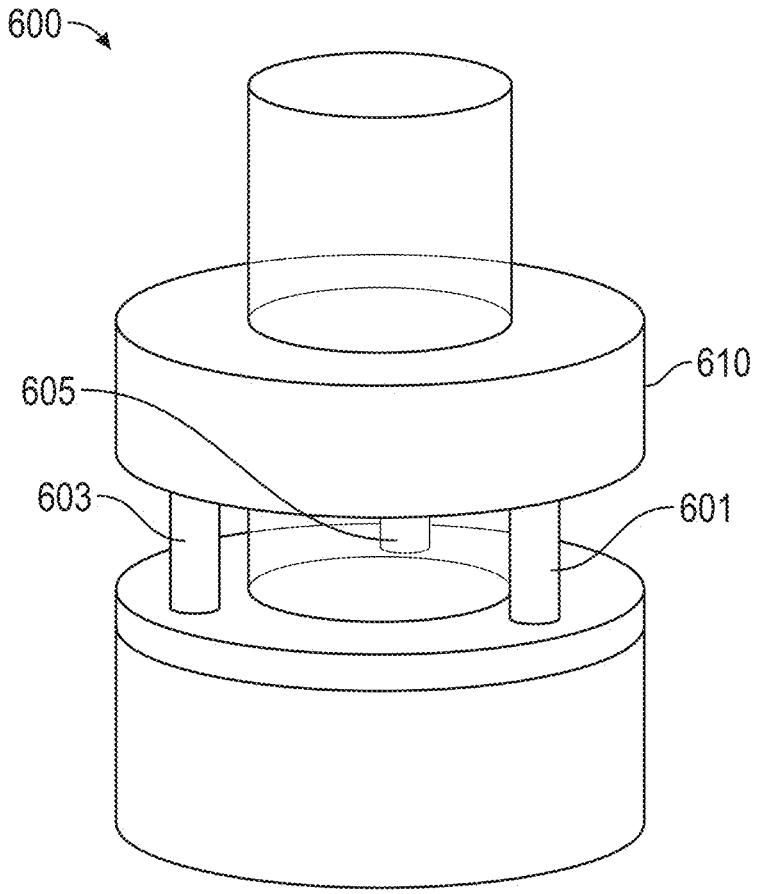
FIG. 6 depicts an illustrative transducer assembly that includes three piezo-transducers loaded with a single body, according to one or more embodiments described.

FIG. 6 depicts an illustrative transducer assembly 600 that includes three piezo-transducers loaded with a single body, according to one or more embodiments. The transducer assembly 600 can include at least three piezo-transducers 601, 603, 605 loaded with a single body 610. In one or more embodiments, the loaded single body 610 can tune each the three piezo-transducers 601, 603, 605 to a desired specific resonance frequency, where at least two of the three or all three of the piezo-transducers 601, 603, and 605 can be tuned to a different resonance frequency.

Figure 7:
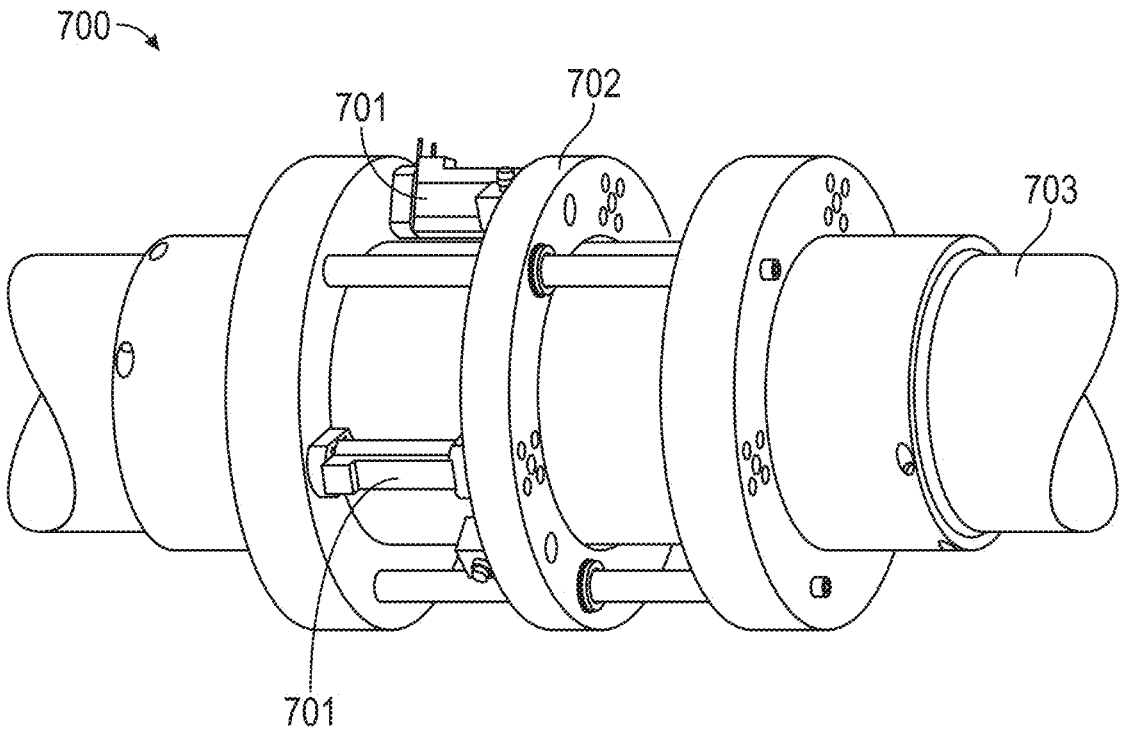
FIG. 7 depicts another illustrative transducer assembly that includes a plurality of transducers loaded with a single body, where the single body is axially centralized around a pipe string, according to one or more embodiments described.

FIG. 7 depicts an illustrative transducer assembly 700 that includes a plurality of transducers 701 loaded with a single body 702 that can be axially centralized around a section of a pipe 703 in a pipe string, according to one or more embodiments. In some embodiments, the single body 702 and/or the stiffness of the plurality of transducers 701 can tune the plurality of transducers 701 to the desired specific resonance frequency. Additionally, the single body 702 and/or plurality of transducers 701, being disposed outside and/or about the pipe string 703, may not affect the acoustic propagation through the pipe string 703.

Figure 8:
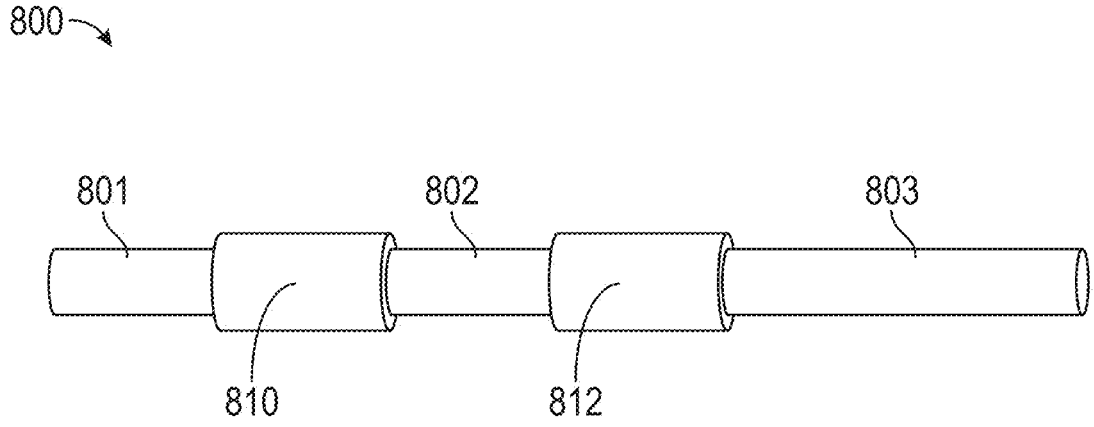
FIG. 8 depicts an illustrative pipe string that includes a plurality of pipe string segments and a plurality of transducer assemblies spatially distributed on or about the pipe string, according to one or more embodiments described.

FIG. 8 depicts an illustrative pipe string 800 that includes a plurality of pipe string segments (three are shown, 801, 802, 803) and a plurality of transducer assemblies (two are shown, 810, 812) spatially distributed on or about the pipe string 800. The plurality of transducer assemblies 810, 812 can be or can include the transducer assemblies 100, 200, 500, 600, and/or 700 as depicted in FIGS. 1, 2, 5, 6, and/or 7.

In some embodiments, the mass-loaded transducers in the transducer assemblies 100, 200, 500, 600, and/or 700 can be tuned such that each mass-loaded transducer in a given transducer assembly can be spaced in frequency, so that the combination of the multiple mass-loaded transducers can provide a wide frequency band for acoustic energy transmission. In some embodiments, the plurality of mass-loaded transducers in each of the plurality of transducer assemblies 100, 200, 500, 600, and/or 700 can include mass-loaded transducers tuned to the same specific frequencies, so that the plurality of mass-loaded transducers can more precisely transmit and receive acoustic signals. In some embodiments, the width of the resonance frequency of an individual mass-loaded transducer can span less than 100 Hz, less than 90 Hz, less than 80 Hz, less than 70 Hz, less than 60 Hz, or less than 50 Hz. In some embodiments, the wide frequency band for acoustic energy transmission can span about 100 Hz, about 200 Hz, about 300 Hz, about 400 Hz, about 500 Hz, or about 600 Hz to about 700 Hz, about 800 Hz, about 900 Hz, or about 1,000 Hz. In some embodiments, the mass-loaded transducers in the transducer assemblies can be tuned to a frequency of less than 3,000 Hz, less than 2,750 Hz, less than 2,500 Hz, less than 2,250 Hz, less than 2,000 Hz, less than 1,750 Hz, less than 1,500 Hz, less than 1,250 Hz, or less than 1,000 Hz.

In some embodiments, the transducer assemblies 100, 200, 500, 600, and/or 700 as depicted in FIGS. 1, 2, 5, 6, and/or 7 can be installed on a pipe string. The pipe string can be located within or outside of a borehole. In some embodiments, the transducer assemblies 100, 200, 500, 600, and/or 700 can be disposed on, mounted upon, and/or attached to the outer surface of the pipe string using any appropriate method to dispose, mount, and/or attach the transducer assemblies 100, 200, 500, 600, and/or 700 to the pipe string. In some embodiments, the transducer assemblies 100, 200, 500, 600, and/or 700 can be spatially distributed on or about the pipe string at distances of about 15 m, about 30 m, about 75 m, about 150 m, about 225 m, about 300 m, about 375 m, about 450 m, about 525 m, or about 600 m to about 900 m, about 1,500 m, about 2,200 m, about 3,000 m, about 3,800 m, or more. In some embodiments, a typical spacing between the transducer assemblies 100, 200, 500, 600, and/or 700 can be about 250 m, about 300 m, or about 365 m to about 1,370 m, about 1,500 m, or about 1,675 m, but such spacing can be much more, e.g., about 2,425 m, 2,750 m, or 3,800 m, or much less, e.g. about 30 m, 60 m, or 90 m, in order to accommodate all possible testing tool configurations.

All patents and patent applications, test procedures (such as ASTM methods, UL methods, and the like), and other documents cited herein are fully incorporated by reference to the extent such disclosure can be not inconsistent with this disclosure and for all jurisdictions in which such incorporation can be permitted.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

The foregoing has also outlined features of several embodiments so that those skilled in the art can better understand the present disclosure. Those skilled in the art should appreciate that they can readily use the present disclosure as a basis for designing or modifying other methods or devices for carrying out the same purposes and/or achieving the same advantages of the embodiments disclosed herein. Those skilled in the art should also realize that such equivalent constructions do not depart from the spirit and scope of the present disclosure, and that they can make various changes, substitutions, and alterations herein without departing from the spirit and scope of the present disclosure, and the scope thereof can be determined by the claims that follow.

What is claimed is:

1. A process for installing a wireless acoustic telemetry system, comprising:

installing the wireless acoustic telemetry system onto a pipe string that is to be located within a borehole, the wireless acoustic telemetry system comprising:

a first plurality of transducer assemblies spatially distributed on or about the pipe string, each transducer assembly of the first plurality of transducer assemblies comprising:

a modem;

a plurality of transducers including:

a first transducer coupled to a first body having a first mass;

a second transducer coupled to a second body having a second mass; and a third transducer coupled to a third body having a third mass, wherein:

the first transducer and the first body form a first mass-loaded transducer configured to produce a first resonance frequency;

the second transducer and the second body form a second mass-loaded transducer configured to produce a second resonance frequency spaced from the first resonance frequency;

the third transducer and the third body form a third mass-loaded transducer configured to produce a third resonance frequency spaced from the first resonance frequency and the second resonance frequency;

the first mass, the second mass, and the third mass are each between 0.1 kg and 3 kg; and a combination of the first mass-loaded transducer, the second mass-loaded transducer, and the third mass-loaded transducer is configured to provide a wider frequency response band for energy transmission as compared to one of the first mass-loaded transducer, the second mass-loaded transducer, and the third mass-loaded transducer alone; and a single-body transducer assembly, wherein the single-body transducer assembly comprises:

a second plurality of transducers, and a single body having a mass of between 1 kg and 8 kg, wherein each transducer in the second plurality of transducers is coupled to the single body such that the single-body transducer assembly comprises a second plurality of mass-loaded transducers coupled to the single body.

2. The process according to claim 1, wherein:

at least two mass-loaded transducers of the single-body transducer assembly are tuned to a specific resonance frequency, and each specific resonance frequency is spaced in frequency such that the at least two mass-loaded transducers of the single-body transducer assembly together are configured to provide a wider frequency response band for energy transmission as compared to one of the at least two mass-loaded transducers of the second plurality of mass-loaded transducers alone.

3. A wireless acoustic telemetry system, comprising:

a first plurality of transducer assemblies spatially distributed on or about a pipe string, each transducer assembly of the first plurality of transducer assemblies comprising:

a modem; and a plurality of transducers including:

a first transducer coupled to a first body having a first mass;

a second transducer coupled to a second body having a second mass; and a third transducer coupled to a third body having a third mass, such that each transducer of the plurality of transducers is independently mass-loaded, wherein:

the first transducer and the first body form a first mass-loaded transducer configured to produce a first resonance frequency;

the second transducer and the second body form a second mass-loaded transducer configured to produce a second resonance frequency, the second resonance frequency spaced from the first resonance frequency;

the third transducer and the third body form a third mass-loaded transducer configured to produce a third resonance frequency, the third resonance frequency spaced from the first resonance frequency and the second resonance frequency;

the first mass, the second mass, and the third mass are each between 0.1 kg and 3 kg; and a combination of the first mass-loaded transducer, the second mass-loaded transducer, and the third mass-loaded transducer is configured to provide a wider frequency response band for energy transmission as compared to one of the first mass-loaded transducer, the second mass-loaded transducer, and the third mass-loaded transducer alone; and a single-body transducer assembly, comprising:

a second plurality of transducers; and a single body having a mass of between 1 kg and 8 kg, wherein each transducer in the second plurality of transducers is coupled to the single body such that the single-body transducer assembly comprises a second plurality of mass-loaded transducers coupled to the single body.

4. The wireless acoustic telemetry system or process according to claim 1, wherein the first mass-loaded transducer, the second mass-loaded transducer, and the third mass-loaded transducer are axially centered around the pipe string.

5. The wireless acoustic telemetry system according to claim 1, wherein each of the plurality of transducers is independently a piezo-electric transducer, a magneto restrictive transducer, or an electromagnetic transducer.

6. The wireless acoustic telemetry system according to claim 1, wherein:

at least two mass-loaded transducers of the second plurality of mass-loaded transducers in the single-body transducer assembly are tuned to a specific resonance frequency, and each specific resonance frequency is spaced in frequency such that the at least two mass-loaded transducers of the single-body transducer assembly together is configured to provide a wider frequency response band for energy transmission as compared to one of the at least two mass-loaded transducers of the second plurality of mass-loaded transducers alone.

7. The wireless acoustic telemetry system according to claim 1, wherein each of the first resonance frequency, the second resonance frequency, and the third resonance frequency is tuned via a stiffness of each transducer in each independently mass-loaded transducer.

8. The wireless acoustic telemetry system according to claim 1, wherein the first resonance frequency, the second resonance frequency, and the third resonance frequency are each no greater than 2 kHz.

* * * * *